US007222825B2

(12) United States Patent
Gilbert

(10) Patent No.: US 7,222,825 B2
(45) Date of Patent: May 29, 2007

(54) LAWN WASTE BAG HOLDER

(76) Inventor: Jeffrey Gilbert, 35166 Glengary Cir., Farmington Hills, MI (US) 48331

( * ) Notice: Subject to any disclaimer, the term of this patent is extended or adjusted under 35 U.S.C. 154(b) by 111 days.

(21) Appl. No.: 10/797,459

(22) Filed: Mar. 10, 2004

(65) Prior Publication Data

US 2005/0199767 A1 Sep. 15, 2005

(51) Int. Cl.
*B65B 67/12* (2006.01)

(52) U.S. Cl. ..... 248/95; 248/97; 141/391

(58) Field of Classification Search ..... 141/390, 141/391; 220/495.08; 248/97, 99, 98; 193/25, 193/25 R, 25 C, 25 FT, 17
See application file for complete search history.

(56) References Cited

U.S. PATENT DOCUMENTS

| | | | | | |
|---|---|---|---|---|---|
| 110,511 | A | * | 12/1870 | Swogger | 248/97 |
| 296,135 | A | * | 4/1884 | Cole | 248/100 |
| 434,514 | A | | 8/1890 | Lamb | |
| 568,253 | A | * | 9/1896 | Howard | 248/99 |
| 999,406 | A | * | 8/1911 | Skelton | 248/97 |
| 1,500,964 | A | * | 7/1924 | Starks | 141/237 |
| 2,073,914 | A | * | 3/1937 | Wilfley | 141/314 |
| 2,720,341 | A | * | 10/1955 | Stirn et al. | 222/195 |
| 3,142,465 | A | * | 7/1964 | Hellner | 248/97 |
| 3,470,651 | A | * | 10/1969 | Simmon | 47/45 |
| 3,638,888 | A | | 2/1972 | Ross | 248/97 |
| 3,866,872 | A | | 2/1975 | Burgess | 248/97 |
| 4,138,139 | A | * | 2/1979 | Alfonso | 280/652 |
| 4,139,029 | A | * | 2/1979 | Geraci | 141/98 |
| 4,202,521 | A | * | 5/1980 | Harding | 248/98 |
| 4,273,167 | A | * | 6/1981 | Stillwell | 141/314 |
| 4,419,232 | A | * | 12/1983 | Arntyr et al. | 210/164 |
| 4,705,246 | A | * | 11/1987 | Wolf | 248/97 |
| 4,749,158 | A | * | 6/1988 | Buckley | 248/98 |
| 5,048,778 | A | * | 9/1991 | Wright | 248/98 |
| 5,107,564 | A | * | 4/1992 | Grumbles | 15/257.1 |
| 5,183,226 | A | * | 2/1993 | Brooks | 248/97 |
| 5,271,589 | A | | 12/1993 | Belous | 248/97 |
| 5,544,781 | A | * | 8/1996 | Mattesky | 220/9.4 |
| 5,765,614 | A | * | 6/1998 | Kardosh | 141/390 |
| 5,868,364 | A | * | 2/1999 | MacMillan | 248/97 |
| 5,918,651 | A | | 7/1999 | Gazdy et al. | 141/391 |
| 6,076,782 | A | * | 6/2000 | Alderman | 248/97 |
| 6,085,647 | A | * | 7/2000 | Burow | 100/295 |
| 6,116,548 | A | * | 9/2000 | Oleson | 248/97 |
| 6,116,549 | A | | 9/2000 | Santa Cruz et al. | 248/97 |
| 6,135,518 | A | * | 10/2000 | Holthaus | 294/1.1 |
| 6,293,505 | B1 | * | 9/2001 | Fan | 248/99 |
| 6,877,534 | B1 | * | 4/2005 | Hendrickson et al. | 141/391 |
| 7,066,432 | B2 | * | 6/2006 | Wood et al. | 248/99 |
| 2005/0103951 | A1 | * | 5/2005 | Metcalfe | 248/99 |

* cited by examiner

*Primary Examiner*—Anita M. King
(74) *Attorney, Agent, or Firm*—Gifford, Krauss, Sprinkle, Anderson & Citkowski, P.C.

(57) ABSTRACT

A yard waste bag loading assembly includes a base having dimensions able to accommodate a yard waste bag therein, the yard waste bag having a given opening size. A plurality of vertical supports extend from the base to a height necessary to accommodate the yard waste bag. A funnel is hingeably secured to the tops of the vertical supports. The funnel has a mouth greater than the bag opening size. The components of the loading assembly are readily formed from tubular plastic pieces, elbow fittings and tee fittings to facilitate easy breakdown and storage.

14 Claims, 2 Drawing Sheets

LAWN WASTE BAG HOLDER

FIELD OF THE INVENTION

The present invention in general relates to a lawn waste bag holder and in particular to a lawn waste bag holder adapted to receive material from a mechanical collector sack.

BACKGROUND OF THE INVENTION

Mechanical lawn mowers and leaf vacuums have greatly eased the burden of lawn care. While some individuals compost yard waste, the vast majority of yard waste is packaged in paper bags and, to a lesser extent, plastic bags. The act of emptying yard waste from a mechanical collector sack into a yard waste bag represents a source of inefficiency. Since the relative size of the opening in a mechanical collector sack is typically greater than the diameter of a lawn waste bag, it is common for yard waste to be spilled onto the ground in the course of yard waste transfer. The collection of this yard waste spillage becomes a significant portion of the time spent performing the overall yard cleanup task.

A still further problem associated with prior art attempts to stabilize a yard disposal bag involves the storage of assemblies that are awkward to store, difficult to assemble, or afford inadequate support for the yard waste bag. Conventional support devices have suffered to varying degrees some or all of these limitations. Thus, there exists a need for a yard waste bag loading device incorporating a funnel large enough to accommodate a mechanical collector sack output along with convenient disassembly and storage.

SUMMARY OF THE INVENTION

A yard waste bag loading assembly includes a base having dimensions able to accommodate a yard waste bag therein, the yard waste bag having a given opening size. A plurality of vertical supports extend from the base to a height necessary to accommodate the yard waste bag. A funnel is hingeably secured to the tops of the vertical supports. The funnel has a mouth greater than the bag opening size. The components of the loading assembly are readily formed from tubular plastic pieces, elbow fittings and tee fittings to facilitate easy breakdown and storage.

DETAILED DESCRIPTION OF THE PREFERRED EMBODIMENTS

Figure 1:
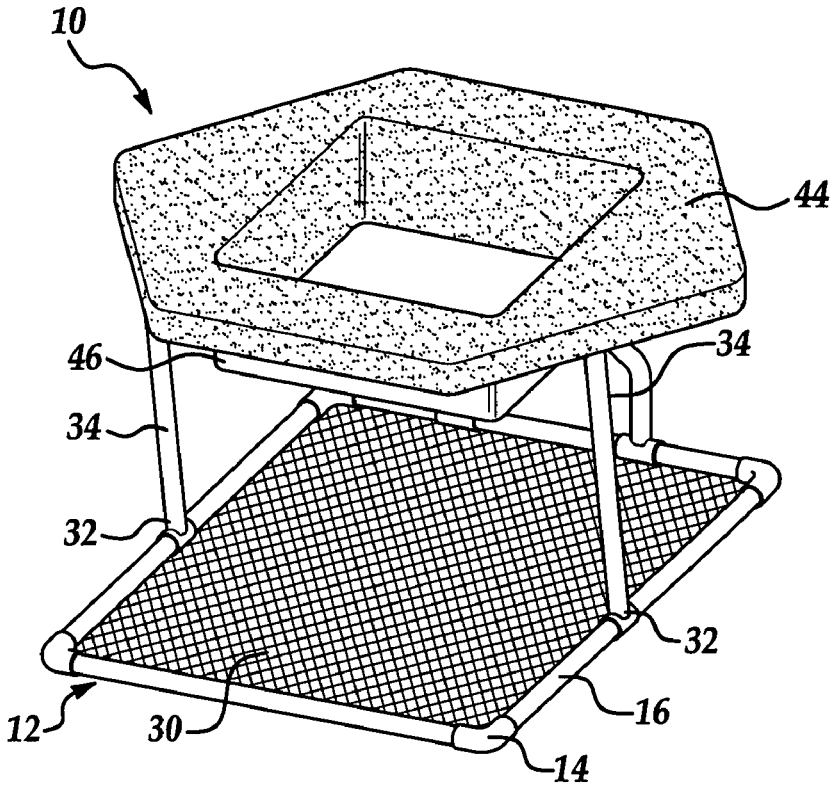
FIG. 1 is a perspective view of a yard waste bag loading assembly according to the present invention with the funnel portion swung clear of a yard waste bag located within the assembly and shown herein in ghost.

The present invention has utility in loading a yard waste bag with a yard waste collection tool or mechanical collector that has a dimension greater than the opening size of the yard waste bag. A base having vertical supports terminates in a funnel that overlies a yard waste bag placed within an inventive assembly where the mouth of the funnel has a dimension greater than the bag opening size thereby leading to considerably less yard waste spillage in the course of bag loading. Hingeable attachment of the funnel to the remainder of the assembly facilitates bag removal and replacement. While the present invention is detailed with respect to a preferred embodiment having structural components formed of conventional polyvinyl chloride plumbing pieces, it is appreciated that an inventive assembly structural component is readily formed from a material illustratively including steel rod, steel tubing, aluminum rod, aluminum tubing, and injection moldable thermoplastics. Additionally, while the embodiment depicted in the figures shows an inventive assembly having a rectilinear base and hexagonal funnel, it is appreciated that the base configuration and funnel configuration are each independently selected from circular, triangular, square, rectilinear, and higher side number polygonal forms.

Referring now to the figures, an inventive yard waste bag loading assembly is shown generally at 10. The assembly 10 has a base 12 enclosing a dimension suitable to accommodate a conventional yard waste bag. Preferably, the base 12 is formed of threaded polyvinyl chloride (PVC) pieces. Linear spans of threaded PVC tubing are joined with right angle elbow fittings to form the base 12. While the base 12 is depicted as a closed square form, it is appreciated that the shape of the base is readily varied. Additionally, it is appreciated that forming a base of an inventive loading assembly from a different aforementioned construction material allows one to form an open-sided base structure. Optionally, a base 12 is modified to support the attachment of at least one wheel 18. As depicted in the figures, a pair of wheels 18 are mounted to the base 12 by drilling an axle hole through opposing elbow fittings 14*a* and 14*b*. An axle 20 extends the distance between 14*a* and 14*b* elbow fittings and wheels are mounted to the exposed ends of the axle 20.

Figure 3:
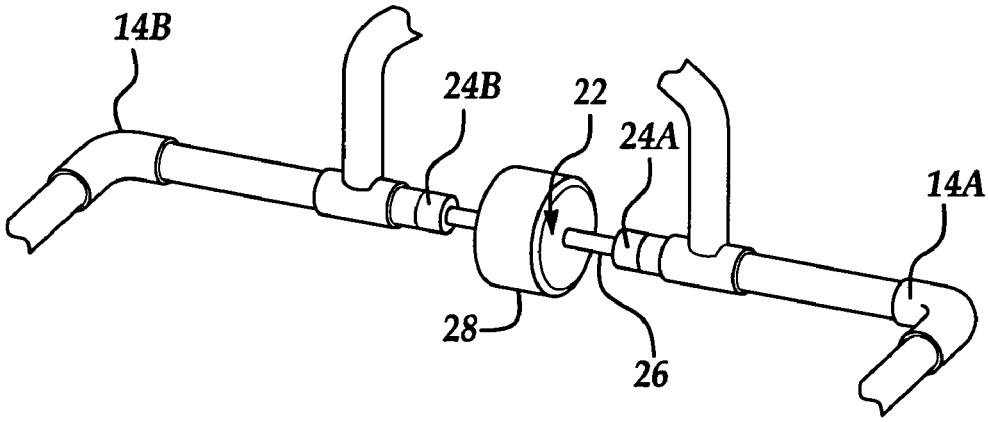
FIG. 3 is a view of an alternate embodiment of an inventive assembly suitable for internal mounting of a base wheel.

In an alternate embodiment depicted in FIG. 3, the base side defined by terminal elbow fittings 14*a* and 14*b* has a gap therein 22 bounded by end cap fittings 24*a* and 24*b*. In the embodiment depicted in FIG. 3, end caps 24*a* and 24*b* are drilled to mount an axle 26 supporting a wheel 28.

Optionally, a bag support screen 30 is supported within the base 12.

Figure 2:
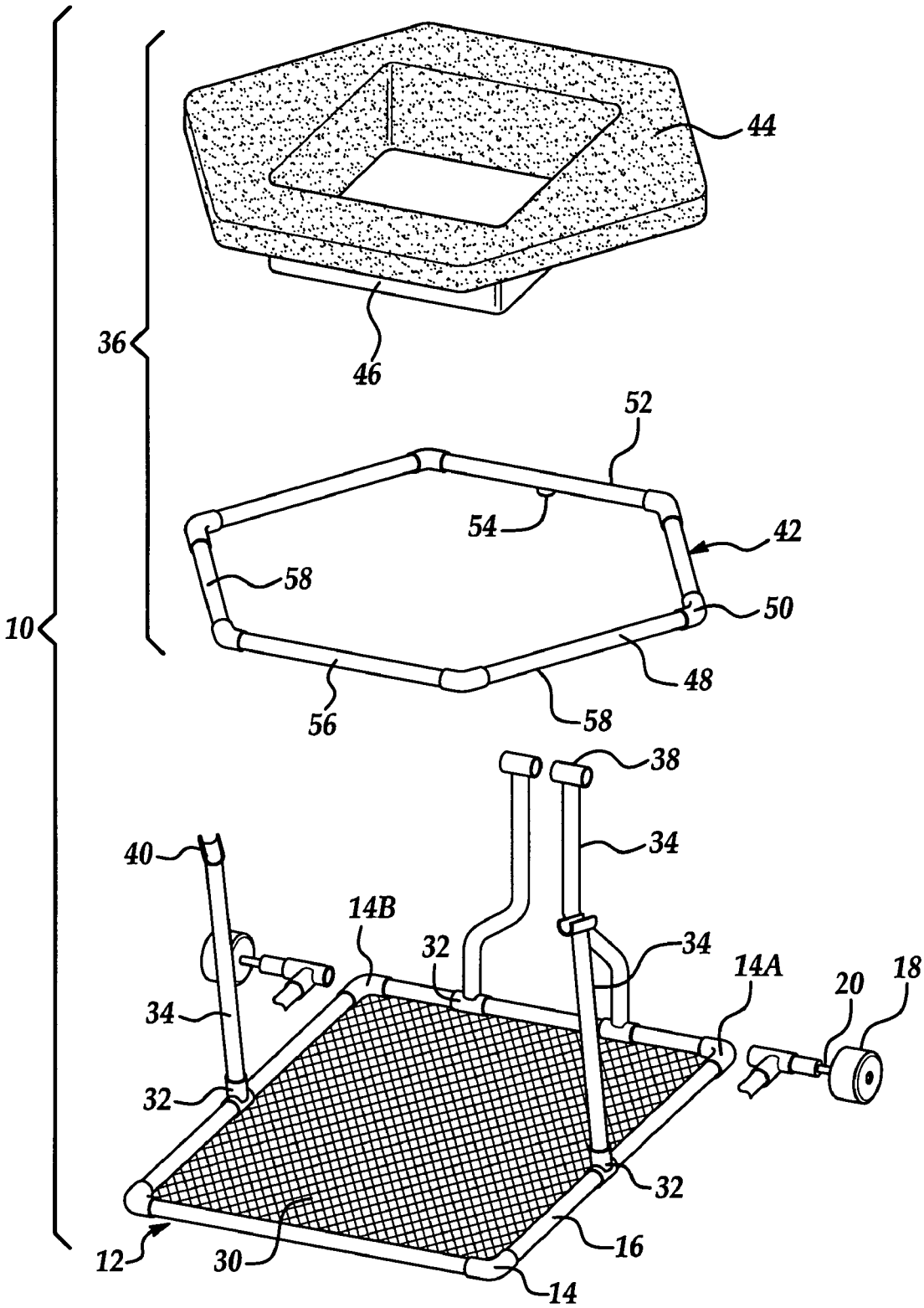
FIG. 2 is an exploded view of the inventive yard waste bag loading assembly shown in FIG. 1.

The base 12 includes at least two side tee fittings 32. The tee fittings 32 serve to anchor vertical supports 34 that extend a height suitable to accommodate a yard waste bag. A funnel sub-assembly 36 rests on the supports 34 to complete an inventive bag loading assembly. In the preferred embodiment depicted in FIGS. 1 and 2, two supports 34 extend from the base side defined by elbows 14*a* and 14*b* to form a pivot point. The hinge pivot point is formed by terminating a support 34 with a tee fitting 38. A funnel assembly having a diameter adapted to rotate within the tee fitting 38 affords a hingeable funnel assembly that is optionally rotatable out of an overlying orientation relative to the base 12. Longitudinally sectioning a tee fitting on the other supports 34 forms a cradle 40 to support the funnel assembly 36 in a position overlying the base 12. While the preferred embodiment depicted in FIGS. 1 and 2 shows a funnel sub-assembly hingeably attached to supports, it is appreciated that two opposing cradle supports are all that is essential to retain a funnel sub-assembly in an operative orientation to fill the yard waste bag. Additionally, while the funnel sub-assembly hinge is depicted in FIGS. 1 and 2 as a pair of spaced tee fittings 38, it is appreciated that only a single support 34 terminating in a single tee fitting 38 on the side defined by elbow fittings 14*a* and 14*b* is sufficient to perform the functions thereof.

A funnel assembly 36 has a rigid frame 42 from which is suspended a fabric wall 44. Preferably, the fabric wall terminates in a rigid or semi-rigid spout 46. The frame 42 as depicted in FIGS. 1 and 2 is hexagonal in shape and formed of threaded PVC tubing sections 48 interspersed with sixty degree elbow joints 50. In order to retain the frame 42 in a fixed position relative to the tee fitting 38, the frame side 52 complementary to the tee fitting 38 includes a short tee fitting 54 that maintains the relative position of the frame 42 relative to the tee fitting 38. The frame 42 is preferably sized such that the cradle 40 supports at least one nonadjacent side of the hexagonal frame 42. As a result, the side opposite 52 or one of the other two nonadjacent sides relative to 52 contacts a support. Preferably, both nonadjacent sides adjoining the adjacent sides relative to side 52 engage support mounted cradles 40. The fabric wall 44 is secured to the frame 42 by conventional means illustratively including stitching, hook-and-loop fasteners, grommets, a zipper, and an elastomeric piping. The fabric wall is formed of materials illustratively including canvas, nylon, and flexible plastic sheeting. Preferably, the inner portion of the fabric wall 44 is secured by a conventional technique to a rigid or semi-rigid spout 46. The spout is illustratively formed of plastic sheeting, cardboard, sheet metal, and stiffened fabric. The spout 46 is dimensioned to insert within the yard waste bag opening. The spout 46 is attached to the fabric wall by conventional techniques illustratively including stitching, adhesives, grommets and the like.

While the present invention has been described herein in the most practical and preferred embodiment, it is appreciated that one skilled in the art upon reading the above description will readily appreciate modifications and variations that nonetheless remain within the scope and spirit of the invention. It is intended that these modifications and variations are interpreted as being within the scope of the appended claims.

The invention claimed is:

1. A yard waste bag loading assembly accommodating a yard waste bag having a bag opening and a bag height comprising:

a base having dimensions to accommodate the yard waste bag;

a plurality of vertical supports extending from said base to a height greater than the bag height; and a funnel hingeably secured to at least one of said plurality of vertical supports, said funnel having a mouth greater than the bag opening;

wherein said funnel comprises a support frame and a fabric wall supported from said frame.

2. The assembly of claim 1 wherein said base is square.

3. The assembly of claim 1 wherein said base has an open side.

4. The assembly of claim 1 further comprising a spout secured to said fabric wall.

5. The assembly of claim 1 wherein said support frame is a unitary construct.

6. The assembly of claim 1 wherein said support frame is hexagonal.

7. The assembly of claim 1 wherein said support frame has a shape selected from the group consisting of: circular, triangular, and higher than four-sided polygonal.

8. The assembly of claim 1 wherein said base is formed of tubular linear pieces joined by elbow fittings.

9. The assembly of claim 8 wherein said tubular linear pieces are plastic.

10. The assembly of claim 1 wherein said support frame is formed of tubular liner pieces joined by elbow fittings.

11. The assembly of claim 10 wherein said tubular linear pieces are plastic.

12. The assembly of claim 1 wherein a top of at least one of said plurality of vertical supports has a split tube cradle adapted to receive a portion of said support frame.

13. The assembly of claim 1 further comprising a wheel rotatably secured to said base.

14. An assembly according to claim 1 further comprising a screen bag support secured to said base.

* * * * *

UNITED STATES PATENT AND TRADEMARK OFFICE

CERTIFICATE OF CORRECTION

PATENT NO. : 7,222,825 B2
APPLICATION NO. : 10/797459
DATED : May 29, 2007
INVENTOR(S) : Jeffrey Gilbert It is certified that error appears in the above-identified patent and that said Letters Patent is hereby corrected as shown below:

Column 4, line 28, replace “liner” with --linear--

Signed and Sealed this

Fourteenth Day of August, 2007

JON W. DUDAS
*Director of the United States Patent and Trademark Office*